United States Patent [19]

Saito et al.

[11] 4,233,340

[45] Nov. 11, 1980

[54] PROCESS FOR PREPARING INSOLUBLE ELECTRODE

[75] Inventors: Shunjiro Saito; Kazuhide Aue; Makoto Kobayashi; Akio Nakamura, all of Tokyo, Japan

[73] Assignee: TDK Electronics Company, Limited, Tokyo, Japan

[21] Appl. No.: 962,659

[22] Filed: Nov. 21, 1978

[30] Foreign Application Priority Data

Dec. 2, 1977 [JP] Japan ..... 52-144751

[51] Int. Cl.[3] ..... B05D 5/12

[52] U.S. Cl. ..... 427/125; 204/290 F; 427/126.5

[58] Field of Search ..... 204/290 R, 290 F; 427/126

[56] References Cited

U.S. PATENT DOCUMENTS

| | | | |
|---|---|---|---|
| 3,632,498 | 1/1972 | Beer | 204/290 F |
| 3,663,414 | 5/1972 | Martinsons | 204/290 F |
| 3,773,554 | 11/1973 | Scrutton et al. | 427/126 |
| 3,773,555 | 11/1973 | Cotton et al. | 204/290 F |
| 3,864,163 | 2/1975 | Beer | 204/290 F |

FOREIGN PATENT DOCUMENTS

| | | | |
|---|---|---|---|
| 1147442 | 4/1969 | United Kingdom | 204/290 F |

*Primary Examiner*—Ronald H. Smith
*Assistant Examiner*—Richard Bueker
*Attorney, Agent, or Firm*—Oblon, Fisher, Spivak, McClelland & Maier

[57] ABSTRACT

An insoluble electrode for electrolysis which comprises repeatedly coating and baking a slurry of palladium oxide containing a platinum compound which can be thermally decomposed to form platinum metal, optionally the other metal salt or oxide in a solvent and a solution of a platinum compound which can be thermally decomposed to form platinum metal in a solvent on a conductive substrate in optional order at two or more times.

8 Claims, No Drawings

PROCESS FOR PREPARING INSOLUBLE ELECTRODE

BACKGROUND OF THE INVENTION

1. Field of the Invention

The present invention relates to an improved process for preparing an electrode for electrolysis.

2. Description of the Prior Art

Heretofore, the alkali metal electrolysis such as sodium chloride electrolysis has been mainly carried out by the mercury process. Recently, the pollution of drainage containing mercury component caused by the mercury process has been discussed. The change of the process from the mercury process to diaphragm processes has been required.

The diaphragm processes have been usually worked at higher pH in the electrolysis in comparison with the mercury process. The known electrodes have low oxygen overvoltage. Accordingly, when the known electrodes are used for the diaphragm process or the ion-exchange membrane process about 1 to 3% of oxygen is included in the resulting chlorine, whereby the anode gas can not be directly fed into petrochemical plants etc. It is necessary to use the anode gas after removing oxygen. Accordingly, special equipments and complicated operations are required to increase the cost.

In order to overcome the disadvantages, an electrode which causes a smaller generation of oxygen should be used. The equilibrium potential of oxygen ($E_{O2}$) is lower than that of chlorine ($E_{Cl2}$). When an electrode which does not have any selectivity in the electrode reaction of oxygen and chlorine is used, a large amount of oxygen is generated at the potential for generating chlorine.

Thus, in order to reduce the generation of oxygen, it is necessary to provide a coated layer which inhibites an oxygen electrode reaction in the theory of reaction rate.

The selectivity of the electrode for the electrode reaction is called as an electrocatalytic activity which has been estimated by an exchange current density of the electrode material.

It has been known that platinum group metals such as Ru, Pd, Rh, Pt and Ir have such electro-catalysis. The exchange current densities of these platinum group metals on the oxygen gas evolution reaction are as follows.

$$Ru > Ir > Rh > Pd > Pt.$$

The exchange current densities on the chlorine gas evolution reaction are as follows.

$$Pd > Ru > Ir > Rh > Pt.$$

From the viewpoints of smaller generation of oxygen and superior electrocatalytic activity on the chlorine gas evolution reaction, palladium is optimum.

However, in the practical use, when palladium is coated in the form of palladium metal, the palladium metal coating is dissolved in the electrolysis and can not be practically used, because of it's corrosive property.

In order to overcome the disadvantages, it has been proposed to use corrosion-resistant electrodes prepared by coating the Pt-Pd alloy on a substrate or by oxidizing the surface of that Pt-Pd alloy. (B.P. 1,147,442, B.P. 1,195,871).

However, the electrocatalytic activity of palladium itself could not be imparted because the alloy of palladium is used and the corrosion-resistance for a long time of the electrode is not satisfactory.

It has been proposed to use an electrode made of Pt-Pd alloy oxide. (B.P. 1,147,442, B.P. 984,973). In order to form the alloy oxide on a titanium substrate, it is necessary to treat it at high temperature in the atmosphere of oxygen under high pressure. In the treatment, the titanium substrate is severly oxidized to be difficult for using it as the electrode. Accordingly, in the proposed method, the Pt-Pd alloy is coated on the titanium substrate and the alloy oxide is formed by the anodic oxidation. The characteristics of the electrode are substantially the same with those of the electrode prepared by oxidizing the surface of the Pt-Pd alloy.

On the other hand, the inventors have studied to coat palladium oxide on a substrate made of titanium etc. However, the adhesiveness of the titanium substrate and the palladium oxide is not enough, and it has not been succeeded.

The inventors have further studied and have succeeded to obtain an electrode which can be practically used, by adding a small amount of the other metal oxide to a large amount of palladium oxide to improve the mechanical strength. However, it has not been succeeded to decrease the consumption of the electrode to substantially zero.

The inventors have further studied the reason why the perfect corrosion-resistance cannot be attained by coating palladium oxide on the titanium substrate and have found that the corrosion is caused by a small amount of metallic palladium. That is, when titanium is directly contacted with palladium oxide or the unreacted palladium compound in the preparation of the palladium oxide coating on the titanium substrate in the thermal decomposing process, the palladium compound is reduced with titanium whereby metallic palladium is formed to contaminate the palladium oxide.

Accordingly, it is considered that the corrosion-resistance is deteriorated by using the electrode having the improved mechanical strength for a long time because the metallic palladium formed by the reduction is dissolved in the electrolysis and the coated layer becomes porous and the coating is fallen down with the generation of the gas from the surface of the electrode.

The inventors have proposed from these facts to prepare an electrode by coating palladium oxide in a form of a complete oxide and a platinum metal on a valve metal substrate made of titanium, tantalum or zirconium.

The feature of the preparation of the electrode is different from a preparation by directly coating a thermally decomposable palladium compound on a substrate and thermally decomposing it, but it is as follows.

Palladium oxide in a complete form is previously formed by thermally decomposing palladium chloride in oxygen or oxidizing palladium black in oxygen. The resulting palladium oxide is dispersed into a butanol solution of a platinum compound which can be thermally decomposed to form platinum metal such as chloroplatinic acid to prepare a slurry for coating. The slurry is coated on a substrate treated by etching in mechanical and chemical manner and baking it at elevated temperature.

In accordance with such preparation, a formation of palladium metal is not found and a thick coated layer having several times of a thickness obtained by the conventional thermal decomposition process can be formed by one coating step and moreover, particles of the coated palladium oxide have larger than those of the conventional thermal decomposition process whereby an improved corrosion characteristic of the electrode is attained. In said case, the platinum component mixed with the palladium oxide should be platinum metal, so that the adhesiveness of the coated palladium oxide with the substrate is improved and the electric contacts between the palladium particles are improved to reduce the electric resistance of the palladium oxide for imparting electrocatalytic activity.

Said electrode has satisfactory electrocatalytic activity and anticorrosive property, however it has a disadvantage that a mechanical peeling-off of the coated layer is easily caused by forming bubbles in the electrolysis.

In order to overcome said disadvantage, the inventors have proposed a preparation of an electrode which comprises forming said coated layer and then, further coating platinum metal as a binder for said coated layer.

The inventors have further studied on these coating processes.

SUMMARY OF THE INVENTION

It is an object of the present invention to overcome the disadvantage that a mechanical peeling-off of a coated layer is easily caused by forming bubbles in an electrolysis by repeatedly forming a coated layer of palladium oxide and platinum metal and a coated layer of platinum metal in optional order to form multi-layers.

It is another object of the present invention to provide a process for preparing an electrode for electrolysis which has high corrosion-resistant property without a peeling-off of a coated layer.

The foregoing and other objects of the present invention have been attained by preparing an insoluble electrode for electrolysis by repeatedly coating and baking a slurry of palladium oxide containing a platinum compound which can be thermally decomposed to form platinum metal, optionally the other metal salt or oxide in a solvent and a solution of a platinum compound which can be thermally decomposed to form platinum metal in a solvent on a conductive substrate in optional order to form multi-layers.

DETAILED DESCRIPTION OF THE PREFERRED EMBODIMENTS

In the process of the present invention, an electrode coated layer (formed by coating and baking the slurry of palladium oxide containing the platinum compound), and a platinum coated layer (formed by coating and baking the solution of the platinum compound), are formed in optional order at two or more times to form multi-layers, whereby platinum is effectively filled in porous voids in the coated layer and accordingly various advantages are provided such as fine particles of palladium oxide are effectively held and the peeling-off of the electrode coated layer caused by a formation of bubbles in an electrolysis is prevented and an electric resistance is reduced by increasing current paths in the coated layer and effective palladium oxide having the electrocatalytic activity is increased.

The main feature of the present invention is to prepare an electrode having the coated layer of palladium oxide and platinum, it is possible to incorporate a small amount of the other metal compound in a form of a halide e.g. a chloride or an organic compound e.g. an alkyl compound which can be thermally decomposed to form the corresponding oxide of cerium, zirconium, tin, antimony, titanium, tantalum or tungsten, into the slurry of palladium oxide containing the platinum compound which can be thermally decomposed to form platinum metal such as chloroplatinic acid, halides and carboxylic acid salts.

The amount of the other metal oxide in the mixture of palladium oxide and platinum metal is usually less than 30 mole % preferably less than 15 mole % to a total metal components.

The conditions of thermal decomposition are preferably to control the oxygen partial pressure to 0.002 to 0.5 atm. and the bake at 400° to 800° C. for 5 to 10 minutes in each coating and to repeat the operation for two or more times and then, to bake for 10 to 60 minutes at the final step.

The solvent used in the process of the present invention is preferably water, ethanol or butanol.

It is possible to add a dispersing agent such as a cationic surfactant, an anionic surfactant and a nonionic surfactant as desired.

The concentration of these compounds in the solvent is usually in a range of 0.01 to 10 g/cc especially 0.2 to 2 g/cc as total metal contents and is decided depending upon the viscosity, the easiness of coating and the thickness of the coated layer.

Incidentally, it is preferable to prepare the coating slurry so as to give the composition of the coated layer comprising 99 to 5 mole % of PdO and 1 to 95 mole % of Pt especially 70 to 30 mole % of PdO and 30 to 70 mole % of Pt from the viewpoint of corrosion-resistant property.

The accelerated wear test of the electrode of the present invention was carried out by the Vaaler's method (J. Electro Chem. Soc., 117,219 (1970)) with the chlorine saturated aqueous solution of sodium chloride (2.5 mole/liter) at 65° C. at pH of 3 in the current density of 100 A/dm$^2$.

The present invention will be further illustrated by certain references and examples.

EXAMPLE 1

Chloroplatinic acid was dissolved in butanol to prepare a solution and a fine powder of palladium oxide was uniformly dispersed in the solution to prepare a coating slurry having 0.1 g/ml of a total metal content which corresponds to 70 mole % of PdO content and 30 mole % of Pt content.

Chloroplatinic acid was dissolved in butanol to prepare a coating solution having 0.1 g/ml of Pt content.

A titanium disc substrate having a diameter of 13 mm and a thickness of 1 mm, was washed for dewaxing with trichloroethylene and the surface of the substrate was dissolved by treating it with 10% aqueous solution of oxalic acid at 80° C. for 30 to 300 minutes.

The coating slurry (a) and the coating solution (b) were repeatedly coated with a brush on the titanium disc substrate and baked in the following order.

| Order | b | a | b | a | b | a | b | a | b |
|---|---|---|---|---|---|---|---|---|---|
| Coating time | 1 | 1 | 1 | 1 | 1 | 1 | 1 | 1 | 4 |

a : coating slurry (PdO: Pt = 70 : 30)
b : coating solution (Pt)

In the baking steps, it was baked at 500° C. in air for 5 minutes in each time, but it was baked at 500° C. in air for 30 minutes in the last step.

The electrode was analyzed by a fluorescent X-ray analysis and a X-ray diffraction to confirm that the coated layer had Pd content of about 550 μg and Pt content of about 750 μg which correspond to 40 mole % of PdO and 60 mole % of Pt which had no free palladium metal (Electrode A).

As the reference, an electrode having a coated layer consisting of 40 mole % of PdO and 60 mole % of Pt was prepared by repeatedly coating and baking a single coating slurry having 40 mole % of PdO content and 60 mole % of Pt content by the same process (Electrode B).

An electrolysis of a chlorine saturated aqueous solution of NaCl (2.5 mole) was carried out at 65° C. at pH of 3 in the current density of 100 A/dm$^2$ for 400 hours by using the resulting electrode (Vaaler's accelerated test). After the electrolysis, a consumption of the electrode was analyzed by the fluorescent X-ray analysis. Results are shown in Table 1.

In order to measure mechanical adhesive strength of the coated layer, a peeling-off test by ultrasonic vibration was carried out for 5 minutes by using the sample used in the electrolysis. Results are also shown in Table 1.

From the results, it is clear that the electrode prepared by the process of the present invention coating two kinds of the cloating slurry and solution had superior mechanical strength and adhesiveness to those of the electrode having the same components prepared by coating one kind of the coating slurry.

TABLE 1

| Type of electrode | Loss of Pd component in electrolysis (%) | Loss of Pd and Pt component in ultrasonic vibration Pd(%) | Pt(%) | Cell voltage (Volt) |
|---|---|---|---|---|
| Electrode of invention electrode A | 2.5 | 4.0 | 3.5 | 2.0 |
| Reference electrode B | 3.0 | 22 | 5.0 | 2.0–2.2 slightly rising |

Results of Electrolysis of 0.5 M-NaCl and ultrasonic vibration tests:
(Coated layer : PdO : Pt = 40:60 mole %)

EXAMPLE 2

Chloroplatinic acid, cerium chloride and butyl titanate were dissolved in ethanol to prepare a solution and a fine powder of palladium oxide was uniformly dispersed in the solution to prepare a coating slurry having 0.1 g/ml of a total metal content which corresponds to 80 mole % of PdO content, 10 mole % of Pt content, 5 mole % of Ce content and 5 mole % of Zr content.

Chloroplatinic acid was dissolved in butanol to prepare a coating solution having 0.1 g/ml of Pt content (same with the coating solution (b) of Example 1).

The coating slurry (a') and the coating solution (b) were repeatedly coated with a brush on the titanium disc substrate of Example 1 and baked in the following order.

| Order | b | a' | b | a' | b | a' | b | a' | b |
|---|---|---|---|---|---|---|---|---|---|
| Coating time | 2 | 2 | 1 | 2 | 1 | 2 | 1 | 2 | 1 |

a' : coating slurry (PdO : Pt : Ce : 2R = 80:10:5:5)
b : coating solution (Pt)

In the baking steps, it was baked at 500° C. in air for 5 minutes in each time, but it was baked at 500° C. in air for 30 minutes in the last step.

The electrode was analyzed by a fluorescent X-ray analysis and a X-ray diffraction to confirm that the coated layer had about Pd content of 1000 μg and Pt content of about 800 μg which correspond to 70 mole % of PdO and 30 mole % of Pt, which had no free palladium metal.

In accordance with the Vaaler's accelerated test of Example 1, the anticorrosion test was carried out by using the resulting electrode.

As the results, the electrolysis could be continued for 1000 hours and a cell voltage was kept in 2.0 Volt during the electrolysis and a loss of Pd content in the electrolysis was only 3.0%.

In accordance with the test method of Example 1, the peeling-off test under the ultrasonic vibration was carried out by using the sample used in the electrolysis. As the results, losses of Pd content and Pt content were respectively less than 3.0%.

EXAMPLE 3

Chloroplatinic acid was dissolved in butanol to prepare a solution and a fine powder of palladium oxide was uniformly dispersed in the solution to prepare a coating slurry having 0.1 g/ml of a total metal content which corresponds to 50 mole % of PdO content and 50 mole % of Pt content.

Chloroplatinic acid was dissolved in butanol to prepare a coating solution having 0.1 g/ml of Pt content (same with the coating solution (b) of Example 1).

The coating slurry (a'') and the coating solution (b) were repeatedly coated with a brush on the titanium disc substrate of Example 1 and baked in the following order.

| Order | a'' | b | a'' | b |
|---|---|---|---|---|
| Coating time | 8 | 5 | 8 | 5 |

a'' : coating slurry (PdO : Pt = 50:50)
b : coating solution (Pt)

In the baking steps, it was baked at 500° C. in air for 5 times, but it was baked at 500° C. in air for 30 minutes in the last step.

The electrode was analyzed to confirm that the coated layer contains Pd content of about 1600 μg and Pt content of about 2200 μg which correspond to 40 mole % of PdO and 60 mole % of Pt which had no free palladium metal.

In accordance with the Vaaler's accelerated test of Example 1, the anticorrosion test was carried out by using the resulting electrode.

As the results, the electrolysis could be continued for 1200 hours and a cell voltage was kept in 1.8 to 1.9 Volt during the electrolysis and a loss of Pd content in the electrolysis was only 5.0%.

In accordance with the test method of Example 1, the peeling-off test under the ultrasonic vibration was carried out by using the sample used in the electrolysis for 1200 hours. As the results, losses of Pd content and Pt content were respectively about 4 to 5%, and deteriorations of strength and adhesiveness of the coated layer caused by the electrolysis were negligible.

What is claimed is:

1. A process for preparing an insoluble electrode for electrolysis which comprises:

(a) coating a conductive substrate with a coating composition selected from the group consisting of:

i. a slurry of palladium oxide in a solvent containing a platinum compound, which can be thermally decomposed to form platinum metal, and ii. a solution of a platinum compound, which can be thermally decomposed to form platinum metal, in a solvent;

(b) baking the substrate treated by step (a);

(c) coating the substrate treated by step (b) with a coating composition selected from the group consisting of said coating composition (a)(i) and said coating composition (a)(ii); wherein the coating composition used in step (c) is different from that used in step (a);

(d) baking the substrate treated by step (c); and (e) repeating steps (a) to (d) two or more times.

2. The process sccording to claim 1 wherein the conductive substrate is made of titanium, tantalum or zirconium.

3. The process according to claim 1 wherein the solvent is water or an alcohol.

4. A process according to claim 1 wherein the platinum compound is a halide, a carboxylic acid salt or a haloplatinic acid.

5. The process according to claim 1 wherein the solution and slurry are prepared so as to give a coated layer comprising 99 to 5 mole % of palladium oxide and 1 to 95 mole % of platinum metal.

6. The process according to claim 1 wherein a compound of cerium, zirconium, titanium, tantalum or tungsten which can be thermally decomposed to form the oxide thereof further incorporated in the slurry of palladium oxide containing the platinum compound.

7. The process according to claim 1 wherein the solution of the platinum compound is immersed into porous voids in a coated layer formed by coating and baking the slurry of palladium oxide containing the platinum compound in a solvent and the platinum compound in the porous voids is converted to platinum metal by the thermal decomposition whereby the porous voids are filled with platinum metal and these steps are repeated to form multi-layers.

8. The process according to claim 1, wherein oxygen is present during the baking steps (b) and (d).

* * * * *